US007028630B2

(12) United States Patent
Metz

(10) Patent No.: US 7,028,630 B2
(45) Date of Patent: Apr. 18, 2006

(54) BOAT DOCKING STABILIZER

(76) Inventor: Thomas F. Metz, 2200 Midland Grove Rd. Suite 102, Roseville, MN (US) 55113

( * ) Notice: Subject to any disclaimer, the term of this patent is extended or adjusted under 35 U.S.C. 154(b) by 0 days.

(21) Appl. No.: 10/982,622

(22) Filed: Nov. 6, 2004

(65) Prior Publication Data

US 2005/0061225 A1 Mar. 24, 2005

Related U.S. Application Data

(63) Continuation-in-part of application No. 10/613,264, filed on Jul. 3, 2003, now abandoned.

(60) Provisional application No. 60/394,729, filed on Jul. 10, 2002.

(51) Int. Cl.
*B63B 21/00* (2006.01)

(52) U.S. Cl. ..... 114/230.16; 114/230.1

(58) Field of Classification Search ..... 114/230.1, 114/219, 230.27, 230.28, 230.15–230.17, 114/218, 49

See application file for complete search history.

(56) References Cited

U.S. PATENT DOCUMENTS 5,138,965 A * 8/1992 Culp ..... 114/230.16

OTHER PUBLICATIONS

Fulton Coupler Handle from webarchive.org Apr. 19, 2003.*

* cited by examiner

*Primary Examiner*—Ed Swinehart
(74) *Attorney, Agent, or Firm*—Janet Peyton Schafer

(57) ABSTRACT

An improved boat docking stabilizer device to an economic, compact and reliable boat mooring apparatus that stabilizes a moored boat for safe boarding and de-boarding of passengers while permitting the boat to roll free with the waves thus preventing damage to either the dock or the moored boat. An improved boat docking stabilizer device which may be used in pairs for mooring a boat to a dock structure or the like. This boat docking stabilizer device includes an adjustable backboard mounted perpendicularly to a dock structure by fastening means, an adjustable vertical support bracket mounted to the backboard, a hitch ball coupler pivotably mounted to the vertical support bracket for receiving a ball hitch mounted on a boat, and means for locking the hitch ball coupler in a ready position and in a locked position.

23 Claims, 9 Drawing Sheets

BOAT DOCKING STABILIZER

This application is a Continuation-in-Part application filed under 37 CFR 1.53 (b) claiming priority of the non-provisional application Ser. No. 10/613,264 filed Jul. 7, 2003, abandoned, which in turn claims priority of the provisional application Ser. No. 60/394,729 filed Jul. 10, 2002. Reference is hereby made to Disclosure Document No. 504145. All subject matter set forth in Non-Provisional application Ser. No. 10/613,264, Provisional application Ser. No. 60/394,729 and document disclosure reference 504145 are incorporated by reference into the present application.

BACKGROUND

This invention relates generally to a boat docking stabilizer which may be used singly or in pairs for mooring a boat to a dock structure or the like. This invention relates specifically to an economic, compact and reliable boat mooring apparatus that in addition to mooring a boat, stabilizes a moored boat for safe boarding and de-boarding of passengers while permitting the boat to roll free with the waves thus preventing damage to either the dock or the moored boat.

SUMMARY

The present invention is directed to an improved, economic, compact and reliable boat docking stabilizer device for mooring a boat to a dock structure and stabilizing the moored boat allowing for safe boarding and de-boarding of passengers from the moored boat, the boat docking stabilizer comprises an adjustable vertical support bracket mounted to the dock, an adapted hitch ball coupler pivotably mounted to the vertical support bracket for receiving a conventional ball hitch mounted on a boat. Means are provided for positioning the adapted hitch ball coupler in a ready position for easy use in mooring the boat and means further provided for positioning the adapted hitch ball coupler in a fixed position once the boat is moored such that motion between the moored side of the boat and the dock is minimized. The boat docking stabilizer device wherein the hitch ball coupler is adapted with a handle mounted linearly to the hitch ball coupler as means for ease of use of the device.

The improved, economic, compact and reliable boat docking stabilizer device for mooring a boat to a dock structure that also stabilizes the moored boat allowing for safe boarding and de-boarding of passengers from the moored boat, the boat docking stabilizer comprises an adjustable backboard mounted perpendicularly to a dock structure by fastening means, an adjustable vertical support bracket mounted to the dock, an adapted hitch ball coupler pivotably mounted to the vertical support bracket for receiving a conventional ball hitch mounted on a boat. The backboard of the boat docking stabilizer device has a parallel row of apertures formed therein as adjustment means for the positioning of the backboard relative to the dock enabling adjustment of the device to a wide range of water levels. The vertical support bracket of the boat docking stabilizer has a parallel row of apertures formed therein as adjustment means for the positioning of the vertical support bracket upon backboard further enlarging the range of water levels which can be accommodated. The adapted hitch ball coupler may be adjusted vertically to accommodate different water levels by moving pivot pin to different apertures in the vertical support bracket. The adapted hitch ball coupler may be positioned in a ready position for ease of use in mooring the boat and the adapted hitch ball coupler may be positioned in a fixed position once the boat is moored to stabilize the motion of the boat relative to the dock by moving a locking pin, received by a tube carried by the hitch ball coupler, into a different pair of apertures in the vertical support bracket such that the adapted hitch ball coupler remains in a desired fixed position minimizing motion of the moored boat relative to the dock.

An improved boat docking stabilizer device for mooring a boat to a dock structure that stabilizes a moored boat allowing for safe boarding and de-boarding of passengers from the moored boat, comprising a pair of such devices positioned apart form each other on a dock such that a boat may be moored between the pair of the devices. An improved boat docking stabilizer device such that the moored boat rides on the water without damage to either the boat or the dock permitting the boat to be left moored for a lengthy period of time. An improved boat docking stabilizer device such that the device could be mounted for use on a larger boat to moor a smaller boat thereto.

For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

Understanding of the invention will be enhanced by referring to the accompanying drawings, in which like numbers refer to like parts in the several views and in which.

DETAILED DESCRIPTION OF THE CURRENTLY PREFERRED EMBODIMENTS

Understanding of the invention will be further enhanced by referring to the following illustrative but non-limiting example.

Figure 1:
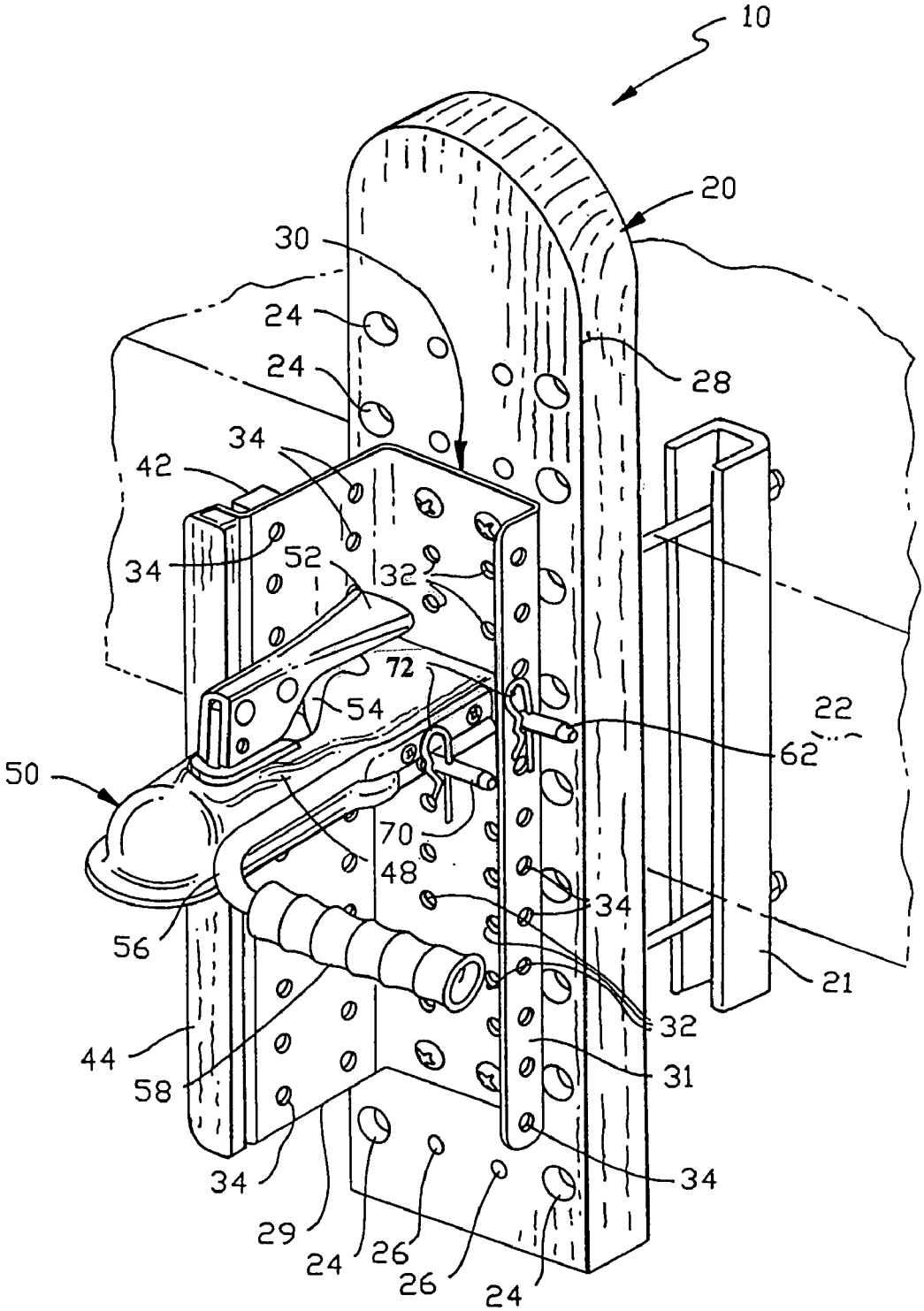
FIG. 1 is a perspective view of a boat docking stabilizer device of the present invention.

Turning now to the drawings, in which like reference characters refer to corresponding elements throughout the several views, FIG. 1 illustrates the assembled boat docking stabilizer 10 of the present invention with a backboard 20 shown mounted by a channel bracket 21 to a dock 22, shown in phantom. Backboard 20 has two rows of apertures 24 formed in parallel rows therein, the apertures 24 formed adjacent the perimeter edge of the backboard 20. The apertures 24 permit the backboard 20 to be mounted in a generally vertical position by nuts and bolts or other fasteners to the dock 22. In actual use conditions, backboard is of wooden material, such as oak, although other resilient yet machinable materials could be used. A second set of bores 26 are formed in parallel rows in a central portion of the backboard 20. These bores 26 permit the vertical support bracket 30 to be mounted by nuts and bolts, screws or other fastening means to the backboard 20. Apertures 32 are formed in parallel rows in the vertical support bracket 30 both to permit the bracket 30 to be mounted to the backboard 20 by screws or other fasteners and to provide a receiver for pivot pin 62 which forms the attachment means for hitch ball coupler 50 to be attached to vertical support bracket 30. The backboard 20 is positioned by fastening means, such as nuts and bolts, screws or other fastening means, to a dock 22 or other structure to which the boat is desired to be moored. Channel bracket 21 is provided in actual use conditions as additional fastening means such that a portion of the dock 22 is sandwiched between channel bracket 21 and backboard 20 to provide stability to attachment of the device to the dock 22 although vertical support bracket 30 could be mounted directly to the dock 22. Use of backboard 20 provides additional adjustment means to accommodate varying water levels. A series of apertures 24 are formed adjacent the perimeter edge 28 of backboard 20 to permit adjustment of backboard 20 depending on the water level such that the device 10 may be used to moor a boat at varying water levels. The backboard 20 may be adjusted vertically by moving fastening means to different pairs of apertures 24. Additionally, when water levels have changed a small amount, vertical support bracket 30 which fastens to backboard 20 by fastening means through holes 32, may be adjusted vertically by moving fastening means to different pairs of holes 32 which line up with bores 26 formed in backboard 20. Vertical adjustment of both backboard 20 and vertical support bracket 30 permit a wide variety of water levels to be easily adjusted for.

Figure 5:
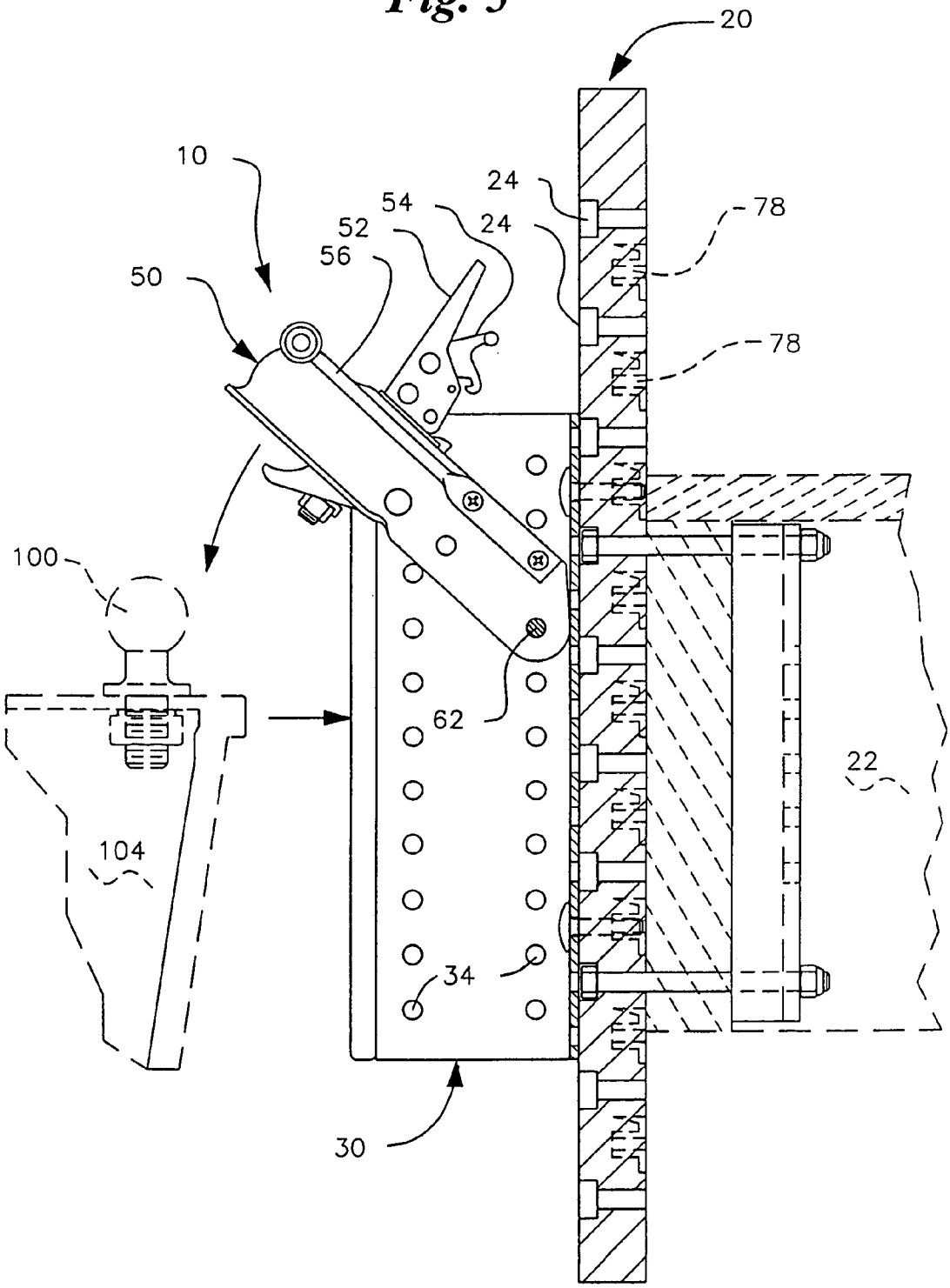
FIG. 5 is a side elevation view with the device in its ready position and the boat mounted hitch ball shown in phantom and the dock shown in phantom.
Figure 7:
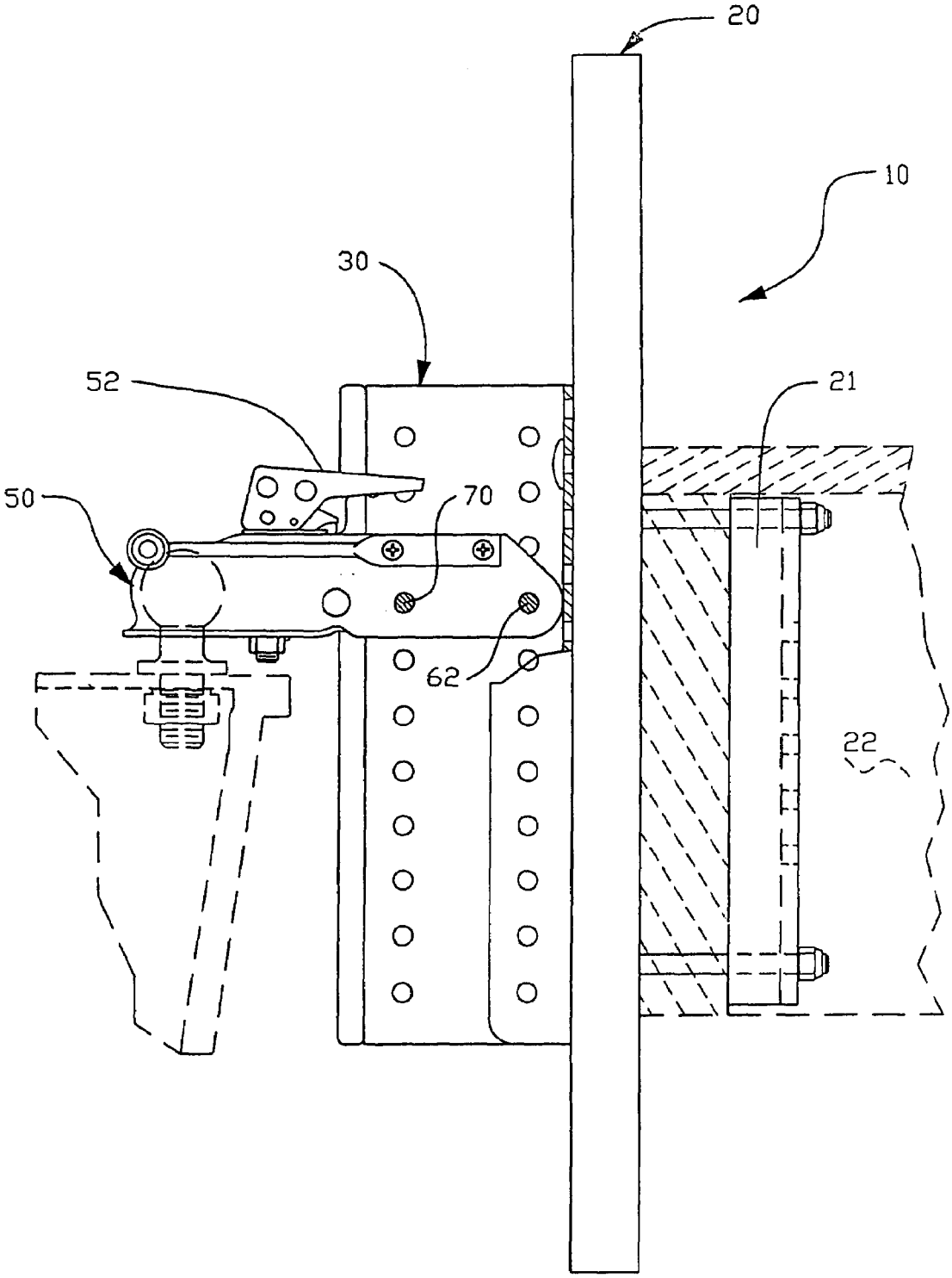
FIG. 7 is a side elevation view with the device shown in its position of use and locked with the hitch ball, boat and dock shown in phantom.

Vertical support bracket 30 has a pair of sides formed therein, a flange 31 and a side wall 29, each of which has having orifices 34 formed therein for the receipt of pivoting pin 62. Additionally, side wall 29 has a second row of orifices 34 for receipt of locking pin 70. A support 42 having a set of openings with a chamfer to assist placement of the locking pin 70 is mounted, in actual use conditions mounted by welds, although other mounting means could be used, to vertical support bracket side wall 29 such that openings align with orifices 34. Support 42 permits locking pin 70, when in its position of use received by the body of hitch ball coupler 50, to position hitch ball coupler 50 either in a fixed position, as shown in FIGS. 1 & 7 or in a ready position as shown in FIG. 5. While the device 10 makes use of the convention locking means of a hitch ball coupler and hitch ball, the safety lever 52 of the hitch ball coupler 50 locks the coupler 50 about a hitch ball 100, the device of this invention in addition fixes the boat to the dock such that the boat is stabilized allowing safe boarding and de-boarding of the docked boat.

Figure 4:
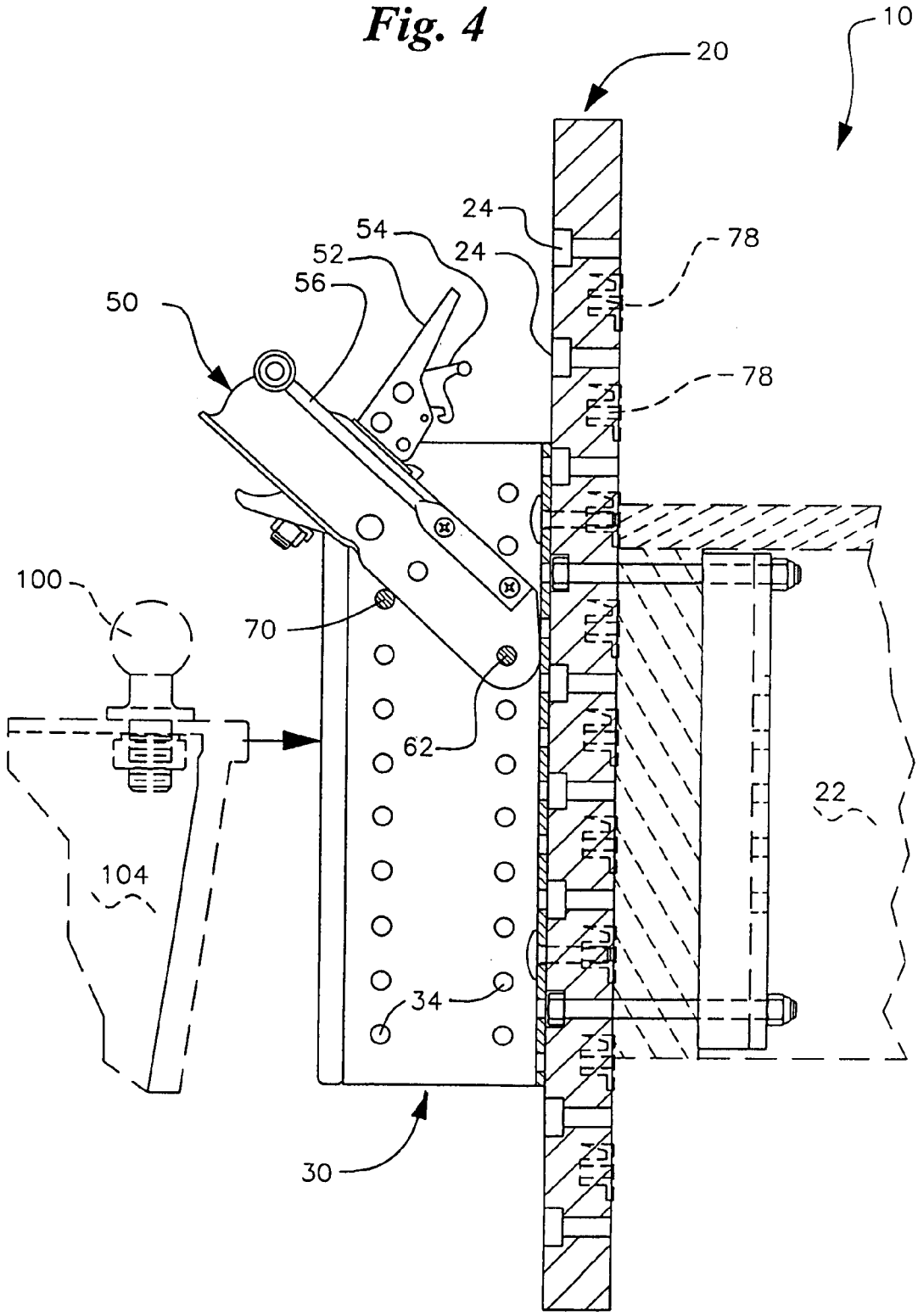
FIG. 4 is a side elevation of the device in its stored position with the boat and dock shown in phantom.
Figure 6:
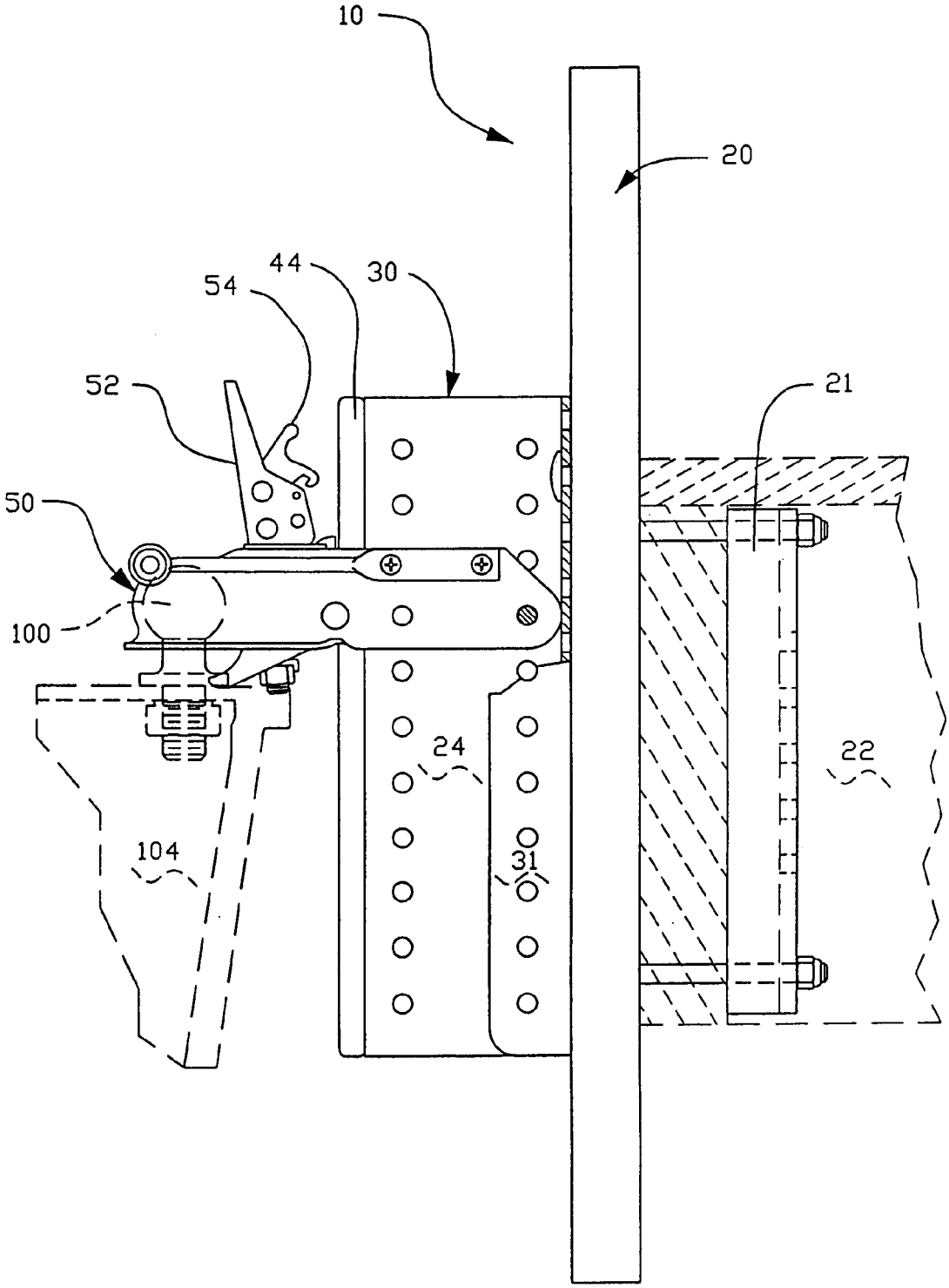
FIG. 6 is a side elevation view with the device shown in its position of use but not locked with the hitch ball, boat and dock shown in phantom.

Cotter pins 72 may be used to fix pivoting pin 62 and locking pin 70 in place, as shown in FIG. 1. Under use conditions, both cotter pins 72, locking pin 70 and pivoting pin 62 may be tethered to the device by cable, wire or the like to prevent these items from being lost in the water when adjusting their positions. Hitch ball coupler 50 has a safety lever 52 and trigger lock 54 which as described above, works in the conventional manner. Hitch ball coupler 50 while shown in standard form, can be adapted such that the hitch ball coupler body 48 is elongated for use with larger boats such as pontoon boats. Handle 56 is attached, in actual use conditions, longitudinally along the side of hitch ball coupler body 48 although handle 56 could be attached elsewhere on hitch ball coupler 50 such as on the dorsal side thereof without departing from the scope and intent of this invention. Handle 56 is equipped with a grip 58 for ease of use of the boat docking stabilizer 10. Glide bar 44 is provided and screw mounted to shelf 46 formed along the edge of vertical support bracket 30 opposite that of flange 31. Glide bar 44 is provided as a bumper to cushion the boat being moored to boat docking stabilizer 10. Chamfered locking pin support 42 that is welded to side wall 29 of vertical support bracket 30, chamfered locking pin support 42 provided to support locking pin 70 into position to either lock hitch ball coupler 50 into a ready position or a locked position, the chamfer provided to guide locking pin 70 into position. Chamfered locking pin support 42 is of stainless steel or other resilient material. Chamfered locking pin support 42 is shaped as a bar of material with chamfered openings that align with side wall orifices 34 permit ease of use of locking pin 70 which may be positioned through hitch ball coupler 50 such that the hitch ball coupler 50 is held in either the ready position, as shown in FIG. 4 note placement of locking pin 70 or the hitch ball coupler 50 has been pivoted to a fixed position, shown in FIG. 7, again note placement of locking pin 70. FIG. 5 shows hitch ball coupler 50 after the locking pin 70 has been removed and hitch ball coupler 50 is pivoted about pivot pin 62 movement is indicated by a downwardly pointing arrow. FIG. 6 indicates hitch ball coupler 50 after being pivoted downwardly such that boat-mounted hitch ball 100 is captured by hitch ball coupler 50. While safety lever 52 locks the hitch ball 100 in hitch ball coupler 50 in the conventional manner, the entire hitch ball coupler 50 is fixed relative to the dock 22 by means of positioning locking pin 70 in vertical support bracket 30. In this manner the boat docking stabilizer 10 is "fixed" in position. All embodiments of this invention utilize this "fixing" of the boat docking stabilizer 10 during attachment of the boat in question to the dock 22 and thus provide a means to stabilize the boat relative to the dock. Because the boat is attached to the dock 22, the movement of the boat relative to the dock is minimized because the boat docking stabilizer 10 is fixed in a horizontal position. The boat may respond to wave action on the non-attached side but movement of the dock side of the boat is minimized with the use of the device of this invention allowing ease of boarding and de-boarding of any boat so attached. This minimizing of wave action occurs with use of the device of this invention, a boat docking stabilizer 10, be it mounted on a dock, a pier, another boat or any fixed mooring device.

Figure 3:
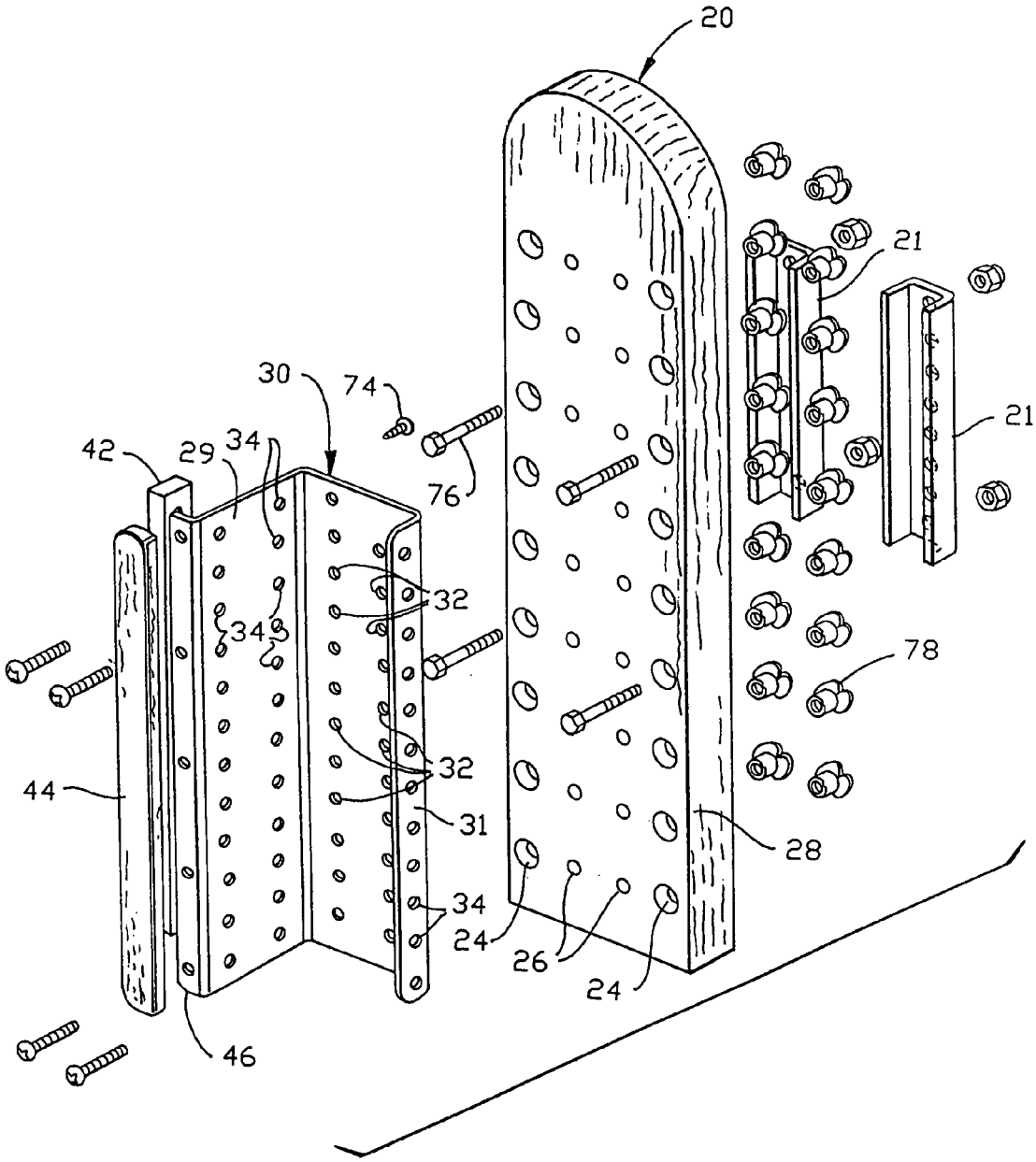
FIG. 3 is an exploded view of the backboard and vertical support bracket portion of the present invention.

A pair of channel brackets 21, FIG. 3 are used to firmly hold the boat docking stabilizer 10 in position on dock 22. Vertical support bracket 30 is of zinc plated steel although other resilient materials could be used, and has a crenelated profile. Vertical support bracket 30 is screw mounted to backboard 20 by screws 74 although other fastening means could be used. Bolts 76 are used to mount backboard 20 to dock 22 although again other fastening means could be used. Channel bracket 21 is positioned inside dock 22 to more firmly attach boat docking stabilizer 10 to dock 22. T nuts 78 are shown as liners for apertures 24 formed in backboard 20 although other reinforcing materials could be used.

FIG. 4 is a side perspective view with some elements shown in cross-section to aid in understanding of the invention. Backboard 20 is bolt-mounted to dock 22 and vertical support bracket 30 is screw mounted to backboard 20. Backboard 20 is shown mounted mid-backboard to the dock 22 although it is understood that backboard 20 may be easily adjusted to accommodate lower or higher water levels. Vertical support bracket 30 also is vertically adjustable compounding the adjustability of boat docking stabilizer 10 in regards to water levels. In FIG. 4, hitch ball coupler 50 is shown raised in a ready position pivoted about pivot pin 62 to permit the user to pull the boat in under the hitch ball coupler 50, and, as shown in FIG. 5, manually release locking pin 70 to lower hitch ball coupler 50 pivoted about pivot pin 62 into position fastening onto hitch ball 100, FIG. 6. Hitch ball coupler 50 is fixed in position in FIG. 7 with safety hitch lever 52 shown in a locked position locking hitch ball 100 into hitch ball coupler 50 in the conventional manner, additionally locking pin 70 fixes hitch ball coupler 50 in a fixed position relative to the dock 22. Use of backboard 20 enhances the adjustability of the device of this invention but boat docking stabilizer 10 works without a backboard 20, as shown in FIG. 10.

Figure 2:
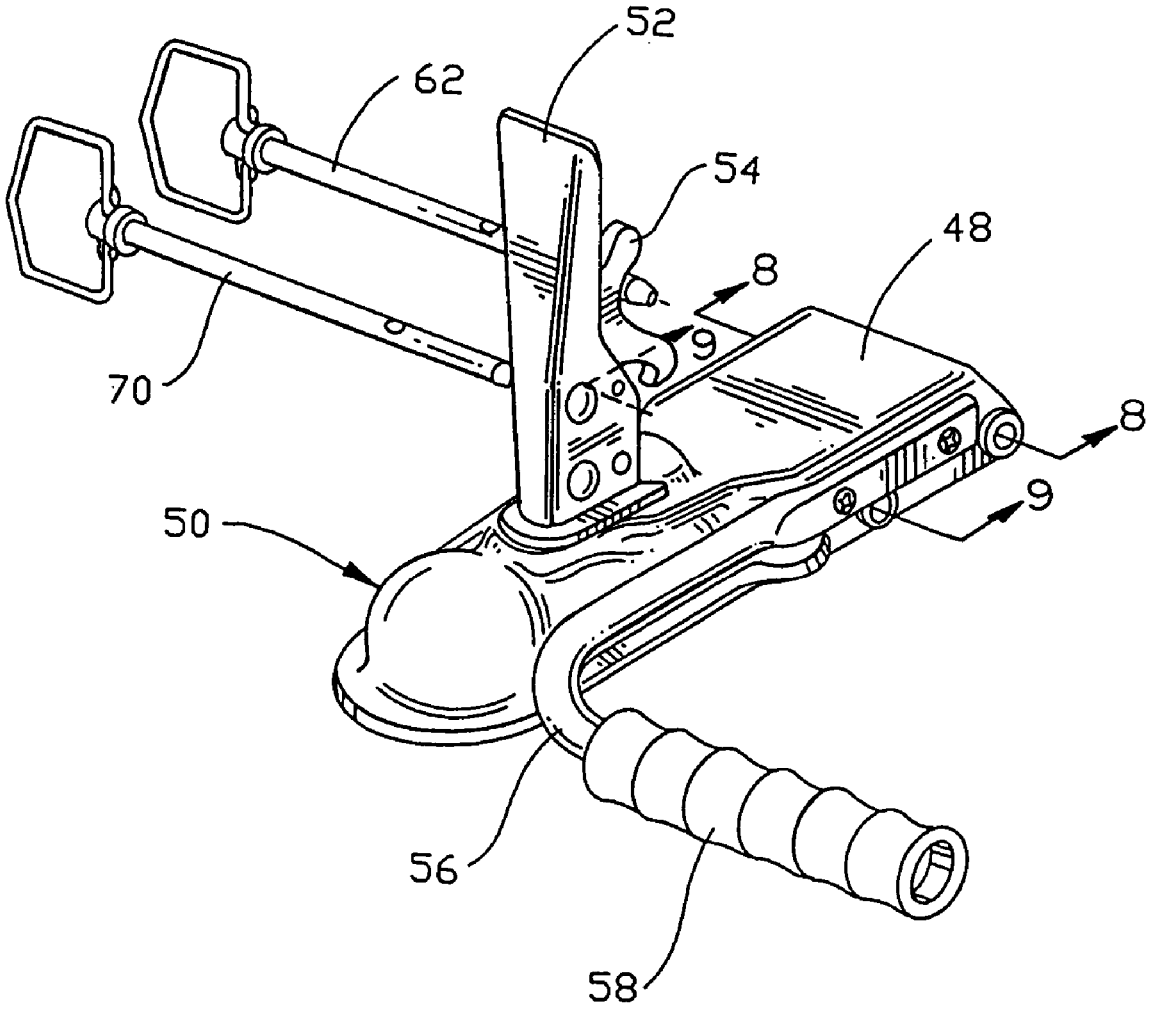
FIG. 2 is a perspective view of the hitch ball coupler portion of the device of the present invention with the locking pin and pivoting pins removed from the device.
Figure 8:
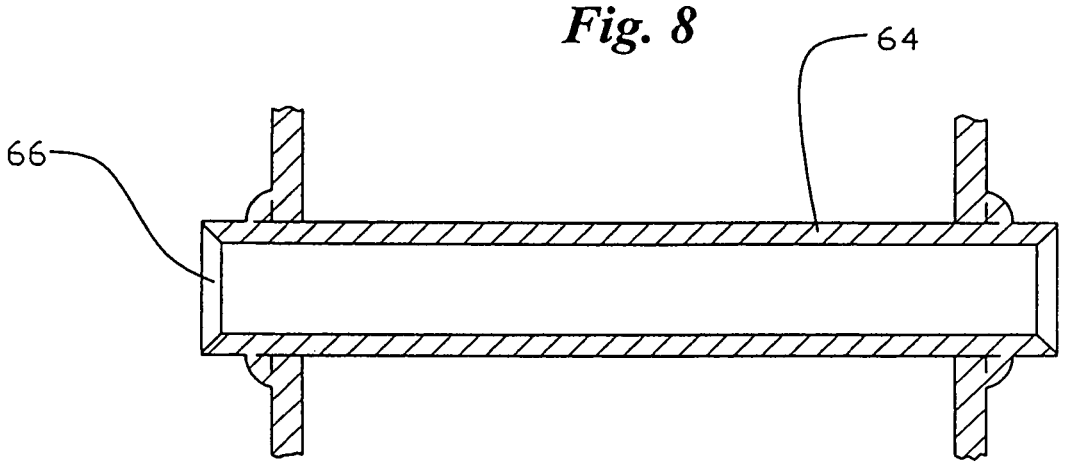
FIG. 8 is a sectional detail, indicated in FIG. 2, of the pivot tube welded into the hitch ball coupler.

FIG. 8 is the pivot pin tube 64 indicated by cross-section at FIG. 2. Pivot pin tube 64 is mounted, by welds in actual use conditions, although other fastening means could be used, are to the underside of hitch ball coupler 50 and forms a chamber into which pivot pin 62 is received and about which hitch ball coupler 50 pivots. A chamfer 66 guides pivot pin 62 into pivot pin tube 64.

Figure 9:
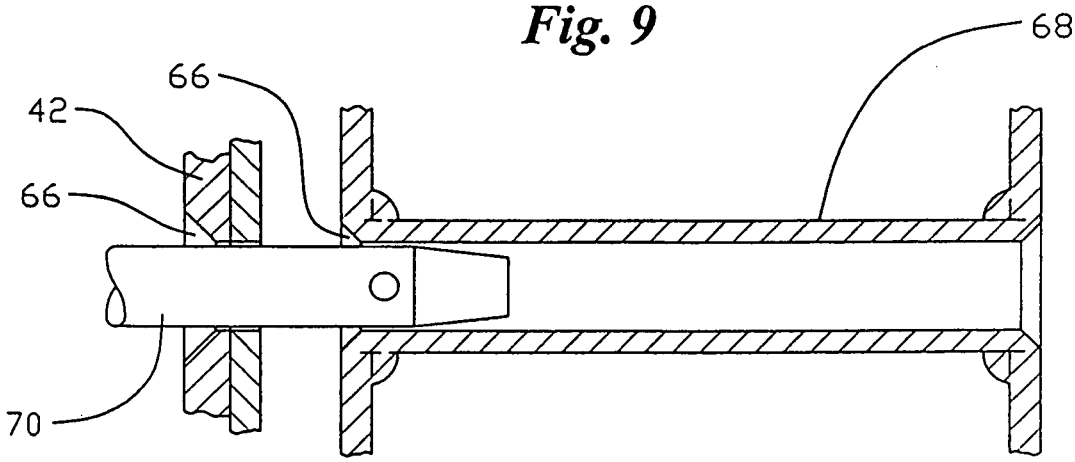
FIG. 9 is a sectional detail, indicated in FIG. 2, of the locking tube welded into the hitch ball coupler.

FIG. 9 illustrates a similar locking pin tube 68 that receives locking pin 70, indicated by cross-section at FIG. 2. A chamfer 66 in both locking pin support 42 and locking pin tube 68 guides locking pin into locking pin tube 68.

Figure 10:
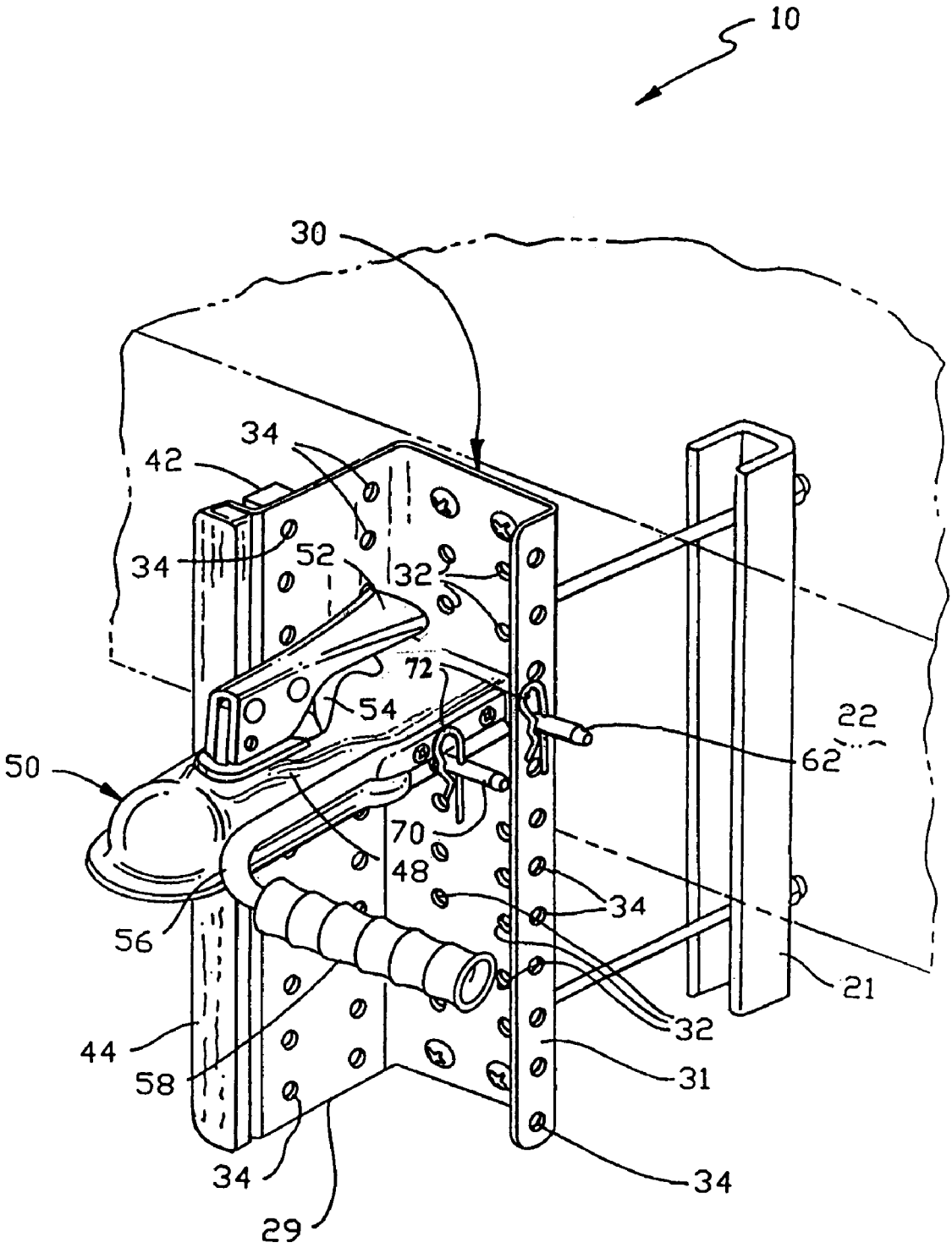
FIG. 10 is a perspective view of a boat docking stabilizer device of the present invention without a backboard.

FIG. 10 illustrates the assembled boat docking stabilizer 10 of the present invention mounted directly by a channel bracket 21 to a dock 22, shown in phantom. While directly mounting the boat docking stabilizer 10 directly to the dock reduces the adjustment capability of the device, in certain situations, it is desirable to forgo the backboard. As shown in FIGS. 1, 3–7 apertures 32 are formed in parallel rows in the vertical support bracket 30 both to permit the bracket 30 to be mounted to the dock by nuts and screws, bolts and nuts or other fasteners and to provide a receiver for pivot pin 62 which forms the attachment means for hitch ball coupler 50 to be attached to vertical support bracket 30. The device 10 is positioned by fastening means, such as nuts and bolts, screws or other fastening means, to a dock 22 or other structure to which the boat is desired to be moored. Channel bracket 21 is provided in actual use conditions as additional fastening means such that a portion of the dock 22 is sandwiched between channel bracket 21 and device 10 to provide stability to attachment of the device to the dock 22. When water levels have changed, vertical support bracket 30 which fastens to dock 22 by fastening means through holes 32, may be adjusted vertically by moving fastening means to different pairs of holes 32. Vertical adjustment of support bracket 30 permit a wide variety of water levels to be easily adjusted for.

As described above, vertical support bracket 30 has a pair of sides formed therein, a flange 31 and a side wall 29, each of which has having orifices 34 formed therein for the receipt of pivoting pin 62. Additionally, side wall 29 has a second row of orifices 34 for receipt of locking pin 70. A support 42 having a set of openings with a chamfer to assist placement of the locking pin 70 is mounted, in actual use conditions mounted by welds, although other mounting means could be used, to vertical support bracket side wall 29 such that openings align with orifices 34. Locking pin support 42 permits locking pin 70, when in its position of use received by the body of hitch ball coupler 50, to position hitch ball coupler 50 either in a fixed position, as shown in FIGS. 1 & 7 or in a ready position as shown in FIG. 5. Cotter pins 72 may be used to fix pivoting pin 62 and locking pin 70 in place, as shown in FIG. 1. Under use conditions, both cotter pins 72, locking pin 70 and pivoting pin 62 may be tethered to the device by cable, wire or the like to prevent these items from being lost in the water when adjusting their positions. Hitch ball coupler 50 has a safety lever 52 and trigger lock 54. Hitch ball coupler 50 while shown in standard form, can be adapted such that the hitch ball coupler body 48 is elongated for use with larger boats such as pontoon boats. The device of this invention fixes the boat in question relative to the dock or other mooring device. Handle 56 is attached, in actual use conditions, along the side of hitch ball coupler body 48 although handle 56 could be attached elsewhere on hitch ball coupler 50 such as on the dorsal side thereof without departing from the scope and intent of this invention. Handle 56 is equipped with a grip 58 for ease of use of the boat docking stabilizer 10. Glide bar 44 is provided and screw mounted to shelf 46 formed along the edge of vertical support bracket 30 opposite that of flange 31. Glide bar 44 is provided as a bumper to cushion the boat being moored to boat docking stabilizer 10. Chamfered locking pin support 42 that is welded to side wall 29 of vertical support bracket 30, chamfered locking pin support 42 provided to support locking pin 70 into position to either lock hitch ball coupler 50 into a ready position or a locked position, the chamfer provided to guide locking pin 70 into position. Chamfered locking pin support 42 is of stainless steel or other resilient material. Chamfered locking pin support 42 is shaped as a bar of material with chamfered openings that align with side wall orifices 34 permit ease of use of locking pin 70 which may be positioned through hitch ball coupler 50 and held in position, either the ready position, as shown in FIG. 4 or the locked position as shown in FIG. 7. A pair of channel brackets 21, FIG. 3 are used to firmly hold the boat docking stabilizer 10 in position on dock 22. Vertical support bracket 30 is of zinc plated steel although other resilient materials could be used, and has a crenelated profile. Vertical support bracket 30 is screw mounted to backboard 20 by screws 74 although other fastening means could be used. Bolts 76 are used to mount backboard 20 to dock 22 although again other fastening means could be used.

In use, the backboard 20, which has been positioned by fastening means, such as nuts and bolts, screws or other fastening means, to a dock 22 or other structure to which the boat is desired to be moored, has mounted thereto in actual use conditions on a distal side thereof channel bracket 21 is used although backboard 20 could be mounted directly to the dock 22. Backboard 20 is vertically adjusted to accommodate changing water level. Prior to leaving from the dock, the device is positioned in a ready position, as shown in FIG. 4 with the hitch ball coupler 50 fixed in at an angle. When the boat is near the mooring location, the locking pin 70 removed, the hitch ball coupler 50 is grasped by the grip 58 on handle 56, and manually pivoted about pivot pin 62 such that hitch ball coupler 50 meets and attached to hitch ball 100 mounted on a boa as indicated in FIG. 5. The device 10 mounted on the backboard 20 can be positioned in a storage position with the hitch ball coupler 50 hanging vertically from pivot pin 62. When the boat approaches, user manually lifts the device 10 by means of handle 56, as shown in FIG.

5, pivoting the device 10 about pivot pin 62 such that hitch ball 100 is received by hitch ball coupler 50, FIG. 6, the hitch ball 100 locked into place by conventional means and by device 10 positioned in a generally horizontal fixed position by placing locking pin 70 in position in vertical support bracket 30, FIG. 7. Using a pair of the devices 10 positioned on the dock or other mooring structure in a spaced apart position, in actual use conditions about six feet apart, provides two fixed attachments of the boat to the dock by device 10 minimizing the effect of wave action on the dock side of the boat and thus provides a stable surface for boarding and de-boarding from dock to boat or between a larger boat and smaller boat.

FIG. 2 illustrates the hitch ball coupler 50 in detail with both locking pin 70 and pivoting pin 62 removed. An off the shelf hitch ball coupler 50, such as manufactured by DL Corp. of Hastings Nebr. can be used. The hitch ball coupler body 48 is lengthened as an adaptation to allow use of the device of this invention with larger boats, such as pontoons. Additionally, the addition of handle 56 is an adaptation. Handle is shown fastened to a side of hitch ball coupler body 48 by screws or other fastening means.

Although the present invention has been described in considerable detail with reference to certain preferred versions thereof, other versions are possible. For example hitch ball coupler 50 couple be adapted in length to accommodate a larger boat such as a pontoon boat. Therefore, the spirit and scope of the appended claims should not be limited to the description of the preferred versions contained herein.

Changes and modifications in the specifically described embodiments can be carried out without departing from the scope of the invention which is intended to be limited only by the scope of the appended claims.

What is claimed is:

1. An improved boat docking stabilizer device for mooring a boat to a dock structure that additionally stabilizes the moored boat allowing for safe boarding and de-boarding of passengers from the moored boat while minimizing the effect of wave action on the moored boat thus preventing damage to either the dock or the moored boat, comprising:

a vertical support bracket mounted to the dock structure;

a parallel row of apertures formed for adjusting said vertical support bracket to accommodate changing water levels;

an adapted hitch ball coupler pivotably mounted to said vertical support bracket, for receiving a hitch ball mounted on a boat; and a locking pin received by said vertical support bracket for fixing entire said hitch ball coupler relative to the dock mooring the boat to the dock.

2. The device of claim 1, wherein said means for adjusting said adapted hitch ball coupler include a pivot pin, which when moved to a different aperture in said vertical support bracket provides further means to accommodate changing water levels.

3. The device of claim 2, wherein said means for positioning said adapted hitch ball coupler in a ready position further comprises said locking pin received by apertures in the vertical support bracket such that the adapted hitch ball coupler is positioned at an angle relative to the dock.

4. The device of claim 3, wherein said locking pin further comprises positioning said adapted hitch ball coupler in a fixed position by placing said locking pin into an aperture in the vertical support bracket such that the boat is fixedly moored to said adapted hitch ball coupler in a generally horizontal position relative to the dock.

5. The device of claim 1, further comprising a glide bar mounted on a surface of said vertical support bracket for providing a bumper surface for the boat relative to the dock.

6. The device of claim 1, wherein means for adjusting said vertical support bracket further includes a parallel row of apertures formed therein as adjustment means for the positioning said boat docking stabilizer device to the dock for accommodating changing water levels.

7. The device of claim 1, wherein said adapted hitch ball coupler further includes a pivot pin, which when moved to a different aperture in said vertical support bracket, provides means to position said boat docking stabilizer device to accommodate changing water levels.

8. The device of claim 1, wherein said locking pin, when in its position of use received by the body of said hitch ball coupler, positions said hitch ball coupler in one of a fixed position, and ready position.

9. The device of claim 1, wherein said vertical support bracket has a parallel row of apertures formed therein as adjustment means for the positioning said boat docking stabilizer device to the dock for accommodating changing water levels.

10. An improved boat docking stabilizer device for mooring a boat to a dock structure that stabilizes a moored boat allowing for safe boarding and de-boarding of passengers from the moored boat while minimizing the effect of wave action on the moored boat thus preventing damage to either the dock or the moored boat and permitting long-term mooring of the boat without damage thereto, comprising:

a backboard, mounted perpendicularly to a dock structure by fastening means;

an adjustable vertical support bracket mounted to said backboard;

means for adjusting said backboard relative to the dock structure to accommodate changing water levels;

means for adjusting said vertical support bracket;

an adapted hitch ball coupler pivotably mounted to said vertical support bracket for receiving a hitch ball mounted on a boat;

means for adjusting said adapted hitch ball coupler; and a locking pin received by vertical support bracket as means for fixing entire said hitch ball coupler relative to the dock minimizing effect of wave action on the moored boat.

11. The device of claim 10, further comprising a glide bar mounted on a surface of said vertical support bracket for providing a bumper surface for the boat relative to the dock.

12. An improved boat docking stabilizer device for mooring a boat to a dock structure that stabilizes a moored boat allowing for safe boarding and de-boarding of passengers from the moored boat while minimizing the effect of wave action on the moored boat thus preventing damage to either the dock or the moored boat and permitting long-term mooring of the boat without damage thereto, comprising:

an adjustable backboard mounted perpendicularly to a dock structure by fastening means, an adjustable vertical support bracket mounted to the dock structure;

means for adjusting said vertical support bracket;

an adapted bitch ball coupler pivotably mounted to said vertical support bracket for receiving a hitch ball mounted on a boat;

means for adjusting said adapted hitch ball coupler;

stabilizing means for minimizing effect of wave action on the moored boat; and a parallel row of apertures formed in said backboard as adjustment means for the positioning of said backboard relative to said dock to accommodate changing water levels.

13. The device of claim 12, wherein said adapted hitch ball coupler further comprises a handle mounted longitudinally along said hitch ball coupler as means for manual use of said device.

14. The device of claim 13, wherein said vertical support bracket has a parallel row of apertures formed therein as adjustment means for the positioning said boat docking stabilizer device to accommodate changing water levels.

15. The device of claim 14, wherein said means for adjusting said adapted hitch ball coupler, such that said coupler maybe adjusted vertically, by moving pivot pin to different apertures in said vertical support bracket.

16. The device of claim 12, wherein said means for positioning said adapted hitch ball coupler in a ready position further comprises a locking pin received by apertures in said vertical support bracket such that said adapted hitch ball coupler is positioned at an angle relative to the dock.

17. The device of claim 12, wherein said stabilizing means further comprise positioning said adapted hitch ball coupler in a fixed position by placing said locking pin into an aperture in said vertical support bracket such that said adapted hitch ball coupler is fixed in a generally horizontal position relative to the dock.

18. The device of claim 12, further comprising a glide bar mounted on a surface of said vertical support bracket for providing a bumper surface for the boat relative to the dock.

19. An improved boat docking stabilizer device for mooring a boat to a dock structure that stabilizes a moored boat allowing for safe boarding and de-boarding of passengers from the moored boat while minimizing the effect of wave action on the moored boat thus preventing damage to either the dock or the moored boat and permitting long-term mooring of the boat without damage thereto, comprising:

an adjustable backboard mounted perpendicularly to a dock structure by fastening means;

an adjustable vertical support bracket mounted to the dock structure;

means for adjusting said vertical support bracket;

an adapted hitch ball coupler pivotably mounted to said vertical support bracket for receiving a hitch ball mounted on a boat;

a pivot pin as means for adjusting said adapted hitch ball coupler to accommodate changing water levels;

a locking pin received by said adapted hitch ball coupler in said vertical support as stabilizing means for minimizing effect of wave action on the moored boat;

means for positioning said pivotably mounted hitch ball coupler in a ready position and in a fixed position further comprising positioning said locking pin received by apertures in the vertical support bracket such that the hitch ball coupler remains in a desired position.

20. The device of claim 19, wherein said backboard has a parallel row of apertures formed therein as adjustment means for the positioning of said backboard relative to the dock.

21. The device of claim 19, further comprising a glide bar mounted on a surface of said vertical support bracket for providing a bumper surface far the boat prior to mooring.

22. The device of claim 19, whereby hitch assembly of claim 19, is secured against pivotal movement by use of a locking pin at the pivoting hitch ball coupler.

23. The device of claim 19, further comprising a glide bar mounted on a surface of said vertical support bracket for providing a bumper surface for the boat relative to the dock.

* * * * *